US010442508B1

(12) United States Patent
Hallett

(10) Patent No.: US 10,442,508 B1
(45) Date of Patent: Oct. 15, 2019

(54) KAYAK WITH A GAP THAT SLIDES OPEN AND CLOSED

(71) Applicant: Paul Hallett, Hong Kong (HK)

(72) Inventor: Paul Hallett, Hong Kong (HK)

( * ) Notice: Subject to any disclaimer, the term of this patent is extended or adjusted under 35 U.S.C. 154(b) by 0 days.

(21) Appl. No.: 16/231,905

(22) Filed: Dec. 24, 2018

(51) Int. Cl.
*B63B 35/71* (2006.01)
*B63B 27/14* (2006.01)
*B63B 7/04* (2006.01)

(52) U.S. Cl.
CPC ..... *B63B 35/71* (2013.01); *B63B 7/04* (2013.01); *B63B 27/146* (2013.01); *B63B 2035/715* (2013.01)

(58) Field of Classification Search
CPC ..... B63B 35/71; B63B 7/04; B63B 2035/715; B63B 27/146
See application file for complete search history.

(56) References Cited

U.S. PATENT DOCUMENTS 4,229,850 A 10/1980 Arcouette
9,422,029 B1 * 8/2016 Niemier ..... B63B 7/04
2008/0098945 A1 * 5/2008 Weber ..... B63B 35/71 114/347
2008/0121166 A1 * 5/2008 Yaron ..... B63B 7/04 114/347
2012/0216389 A1 * 8/2012 Becker ..... B63B 35/7916 29/525.01
2013/0074760 A1 3/2013 VanNimwegen

* cited by examiner

*Primary Examiner* — Stephen P Avila
(74) *Attorney, Agent, or Firm* — Eric Hanscom

(57) ABSTRACT

A two-section kayak is disclosed where a user can create a gap between a kayak front section and a kayak back section, and use this gap to enter and exit the water. Connecting poles are preferably used to create the gap and retain structural integrity of the kayak when the two sections are separated. A variety of foot stirrups and ladders are contemplated to allow a user to more easily reenter the kayak through the gap. One or more gap alcoves are contemplated to store a stirrup or ladder and to allow the user ready access to swimming, snorkeling and scuba diving accessories while in the gap. A viewing portal, and a hanging seat/platform are contemplated for attachment in the gap, to allow users a more varied kayaking experience. An optional third kayak section is contemplated to add storage space or turn a single kayak into a double kayak.

15 Claims, 6 Drawing Sheets

KAYAK WITH A GAP THAT SLIDES OPEN AND CLOSED

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of kayaks, and more specifically to a sit-on-top kayak constructed as a front section and a back section joined by rigid connecting members, optionally connecting poles or connecting telescoping poles, allowing the kayak user to open and close a gap between these two sections. This gap allows users of the invention to enter the water for swimming, snorkeling or scuba diving, without having to lower themselves off the side of the kayak. More importantly, the gap also allows users to easily and safely climb back into the kayak from deep water, either after an intentional swim or an accidental capsize. It is also contemplated that a step, foot stirrup or ladder of some kind deployed in the gap will make reentering the kayak even simpler. The invention also contemplates a number of attachments for the gap to allow users a more varied kayaking experience.

Kayaking has become one of the fastest growing leisure sports over the past 30 years. While traditional kayaks are "closed cockpit", where a spray skirt serves as a watertight barrier between the ocean and the inside of the kayak, "sit-on-top" kayaks, where the user sits on top of a sealed, molded base, are by far the most popular kayaks today. With a sit-on-top kayak, because the user is held in by nothing more than gravity, a tipping of the kayak (e.g. when jostled by a wave) will often see the user take an unintended swim, then face the challenge of self-rescue, i.e. clambering back into the kayak. In rough or cold waters, particularly for users who are overweight and/or lack strength/agility, the situation can be extremely dangerous, with perhaps only minutes before fatigue/hypothermia sets in. Indeed, drowning after failed self-rescue attempts is a common cause of kayak-related deaths. Thus, a kayak that can be easily and safely reentered from deep water under such circumstances is desirable.

There are some techniques and prior art designed to make re-entering a kayak somewhat easier, yet all these prove at best awkward, even for fit and agile users in safe conditions. An often-taught self-rescue technique is called BBL (Belly, Butt, Legs), in which users pull themselves up and over the side of the kayak, then roll over so that their bottoms are in the molded cavity of the kayak, then bring their legs into the kayak. Some users carry a foot stirrup, commonly tied to a paddle during a self-rescue attempt, with the option of an inflatable paddle float, to lessen the kayak's tendency to capsize (a kayak is very unstable about its longitudinal axis, hence will naturally tip when a user attempts to climb in over the side). Even using these techniques and self-rescue aids, it's all too easy to capsize the kayak, bruise one's ribs, or break a paddle while using a foot stirrup. Thus, even for a fit and agile user in safe conditions (warm and calm water), a kayak that can be more easily reentered is desirable.

While less challenging than reentering a kayak from deep water, voluntarily leaving a kayak to swim, snorkel or scuba dive can also be difficult. Because sit-on-top kayaks have a raised edge, the user has to first balance on this edge, dangle his or her legs over the side, then push off and enter the water. Weight on the edge of the kayak during this process can easily capsize the kayak. A capsize is not only inconvenient (it's a struggle to right a capsized kayak, and unsecured possessions fall in the sea), but can also prove dangerous when the capsizing kayak falls on the user's head.

Thus, there exists a need for a kayak that can be easily and safely exited, and just as easily and safely re-entered.

BRIEF SUMMARY OF THE INVENTION

The current invention provides just such a solution by having a two-section kayak that can be slid open via one or more or rigid connecting members, preferably two connecting poles, to create a gap through which a user can enter and exit the water. This significantly reduces risk of capsizing the kayak, since the user's weight remains on the longitudinal axis of the kayak throughout entry and exit. To enter the water for a swim, snorkel or scuba dive, the user simply detaches the two kayak sections, slides them apart, then slips directly from the kayak seat into the water, steadying entry if desired by placing hands on the connecting poles either side of the gap. To exit the water, the user can place body weight on the connecting poles either side of the gap, and climb directly back into the kayak seat, with no kayak edge to surmount. Then slide the two kayak sections back together before latching them closed.

While reentering the kayak from the gap is already far easier and more stable than reentering over the kayak's side, the user can also deploy a step, stirrup or ladder of some kind to make reentry via the gap even simpler. Various options are contemplated, including a foot stirrup, a telescoping ladder and a rope ladder.

The invention also contemplates storage alcove(s) in either or both of the front and back sections of the kayak, revealed when the kayak sections slide apart. Such alcove(s) may be used to store/deploy a foot stirrup or ladder, and/or used to store and provide convenient access to swimming, snorkeling and scuba diving accessories, for example goggles, a facemask, a snorkel, a waterproof camera and a diving line.

When the kayak is in shallow water, the user can simply stand up from and sit back down on the kayak seat when the gap is open, and in very shallow water can step over the connecting poles to enter the gap (rather than swim under them). In water between waist and chest deep, the user can reenter the kayak by holding the connecting poles either side, then jumping back into the seat.

The user can also open the gap for purposes other than entering and exiting the water. For example, a user may want to use the gap to scout for good snorkeling locations. Another user may want to fish in the gap. Yet another user may simply want to dangle his or her legs in the gap, to cool off on a hot day.

The invention also contemplates a number of attachments for the gap to allow users a more varied kayaking experience. For example, one embodiment of the invention calls for a viewing portal with a transparent base to be attached in the gap, thereby allowing the user to view the undersea world without leaving the kayak.

Another embodiment of the invention calls for an underwater seat/platform to be suspended in the gap, allowing the user to sit, kneel or stand in the gap, and even paddle the kayak from that position.

Another embodiment of the invention calls for an optional third section, thereby turning a single kayak into a double kayak, or a longer single kayak with additional storage space.

Regardless of how the gap is used, the fact that the kayak comes in two sections will allow it to be more easily stored and transported (in a vehicle, then carried to the water), as each section by itself is shorter and lighter than a full kayak.

OBJECTS OF THE INVENTION

It is therefore an object of the present invention to provide a kayak that can be safely exited and re-entered.

An additional object of the invention is to provide a kayak that has two sections, which can be selectively separated from each other to create a gap.

A further object of the invention is to provide a kayak with a gap through which a user can safely and easily enter and exit the water.

Another object of the invention is to provide a kayak with a mechanism that allows the user to create and remove the gap as he/she desires.

An additional object of the invention is to create a kayak with a gap that can be used to selectively house a viewing portal.

An additional object of the invention is to create a kayak with a gap in which the user can sit, kneel or stand, either to rest, or to paddle the kayak.

A further object of the invention is to allow the user convenient access to swimming, snorkeling and diving accessories while in the gap.

Another object of the invention is to provide a kayak that the user can optionally extend in length via addition of a third kayak section.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE INVENTION

Figure 1:
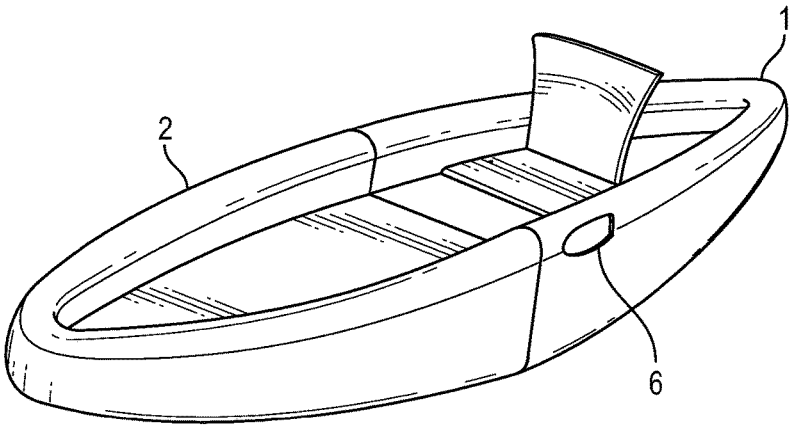
FIG. 1 is a perspective view of one embodiment of the invention, showing the kayak with gap closed.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Figure 2:
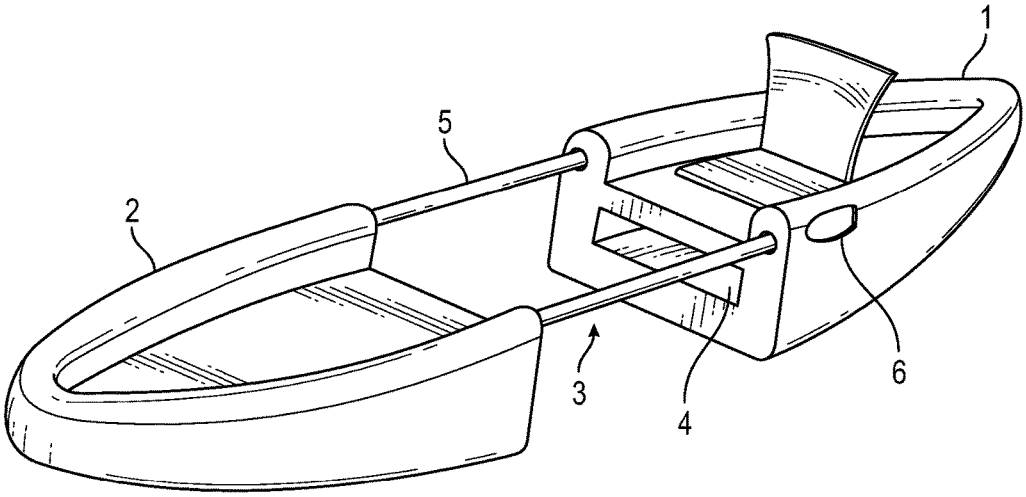
FIG. 2 is a perspective view of the same embodiment of the invention, showing the kayak with gap open.
Figure 3:
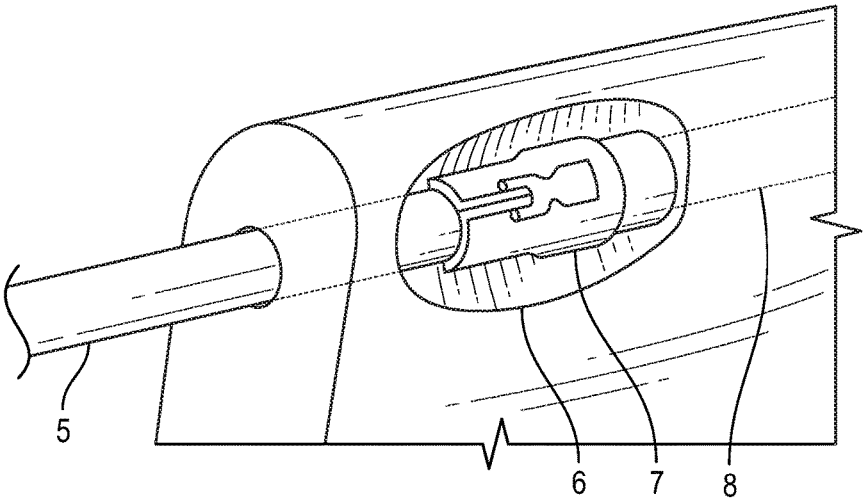
FIG. 3 is a perspective detail view showing one preferred embodiment of a latching mechanism for kayak connecting poles.

A preferred embodiment of the invention has a kayak molded in two sections: a kayak front section 2 and a kayak back section 1. The two sections each have their own interior cavities containing separate volumes of air, and can be selectively slid apart to create a gap 3 between the two sections. With reference to FIGS. 1-3, a user seated in the kayak back section 1 can open the gap 3 by first opening the connecting pole latches 6 then pushing with the feet on the kayak front section 2 to open a gap of desired width. To fix a gap of desired width, the user then closes the connecting pole latches 6. To close the gap 3, the user repeats this in reverse, pulling with the feet on the kayak front section 2.

FIG. 3 shows a preferred embodiment of the invention where the user can open connecting pole latches 7, allowing connecting poles 5 fixed in kayak front section to slide through the hidden connecting poles 8 fixed in the kayak back section. This is because the hidden connecting poles 8 have slightly larger diameter than the connecting poles 5, allowing a telescoping movement. There is much available prior art for latching telescoping poles open and closed, used for example with hiking poles, telescoping window cleaning poles, and certain kinds of telescoping fishing poles. Such prior art latching mechanisms commonly rely on levers, clamps, spring loaded buttons or twisting elements. FIG. 3. shows a simple lever latch.

In FIG. 3, the hidden connecting poles 8 must be hollow to allow the connecting poles 5 to slide through them. It would be possible however to have no hidden connecting poles, rather the kayak back section could be molded to include recesses that function in the same way, i.e. to provide a space that the connecting poles can slide in and out of.

A variation on fixing the connecting poles into the kayak front section, would be to also include hidden kayak connecting poles in the kayak front section 2, i.e. the connecting poles would slide in and out of both kayak sections.

The connecting poles could also be fixed in the kayak back section 1, and slide through hidden connecting poles in the kayak front section.

There could be more than one connecting pole on one or both sides of the gap, to add stability. It is specifically contemplated that four connecting poles could be used, with two connecting poles positioned on either side of the gap.

With reference to FIG. 2 and FIG. 3, the connecting pole latch recesses 6 allow the user access to the connecting pole latches 7, either when seated in the kayak, or from the water. They could also be placed on the top of the edge, or on the inside top edge.

The connecting pole latches 6 are perfectly placed to help secure the kayak gap closed when the user is paddling the kayak. Other prior art modular kayaks will typically place latches or ratchet straps at the joins along the top edges. To keep the two halves even more firmly together when the gap is not being used, tension latches or ratchet straps could also be placed on the floor of the kayak (on the join), or at other points along the joint.

With existing modular kayaks, the structural integrity necessarily depends on their mechanisms for keeping the kayak securely closed. This is because failure could mean the kayak breaking into two pieces on open water, and the user perhaps drowning as a result. The current invention provides a superior design over existing modular kayaks. If the mechanism to keep the kayak closed in the current invention were to fail, then while it might be a little annoying, the kayak is still structurally sound, thanks to the connecting poles, and the user is not at risk.

The connecting poles 5 shown in the figures are of circular cross section. However square, oval, rectangular and other cross sections are contemplated for rigid connecting members that could be made from many different materials, including carbon fiber, wood, plastic, aluminum, steel, etc. Rigid connecting members can be hollow or solid. The different options here have advantages and disadvantages in adding weight to the kayak, strength and functionality. With a strong enough rigid connecting member, e.g. one with tall rectangular cross section, it would be possible to have a single rigid connecting member on only one side of the gap, and no rigid connecting member at tall on the other side of the gap.

Figure 4:
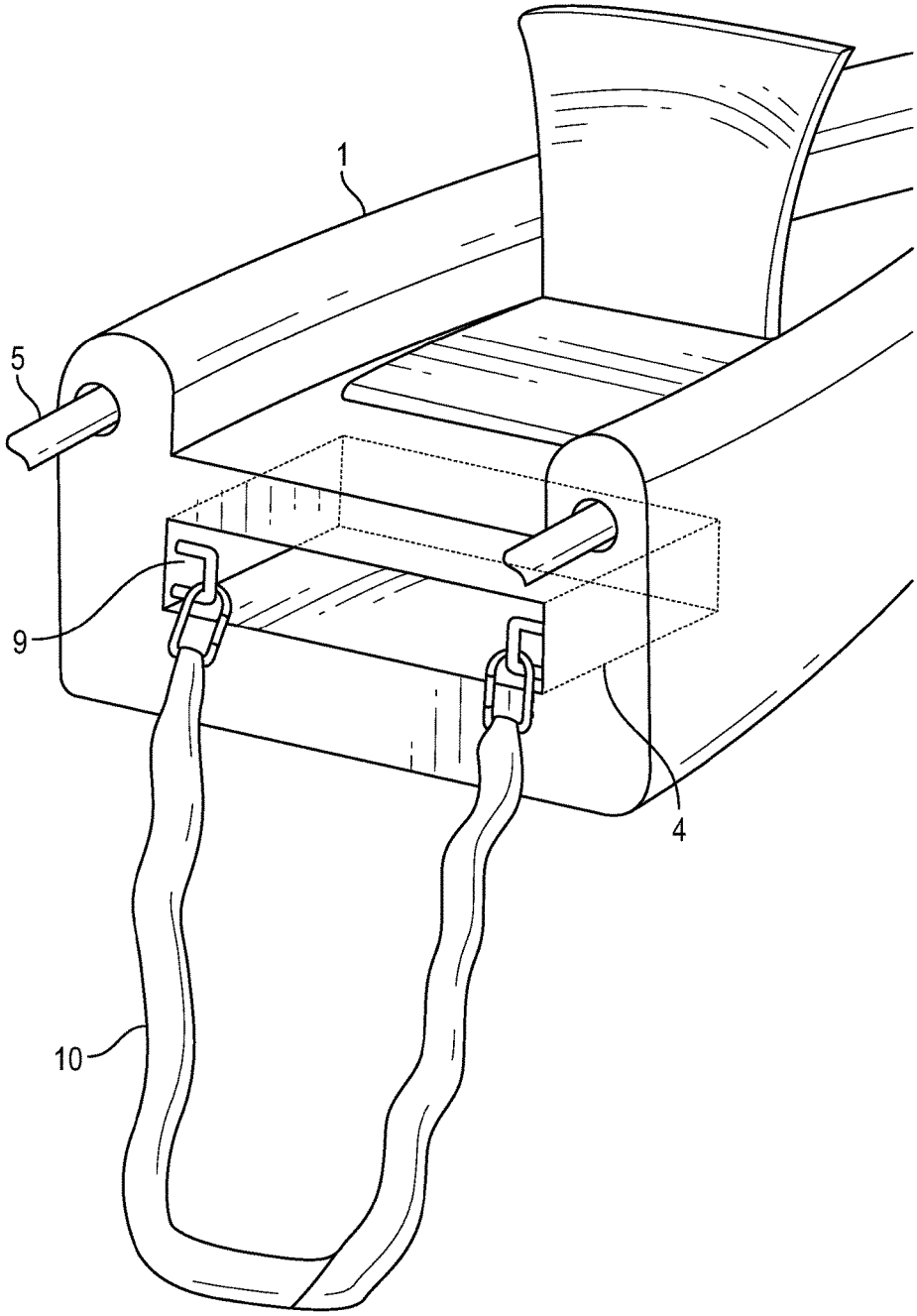
FIG. 4 is perspective view showing one preferred embodiment of a gap alcove with alcove foot stirrup deployed in the gap.

FIG. 4 shows a gap storage alcove 4 in the kayak back section 1, revealed when the gap is opened. The alcove is simply a space, closed on all sides except for the side facing the gap, so that any water entering the alcove will not leak into the interior cavity of the kayak section. The alcove's depth can depend on intended use, for example storage of a telescoping ladder will require greater depth than storage of a foot stirrup.

Figure 5:
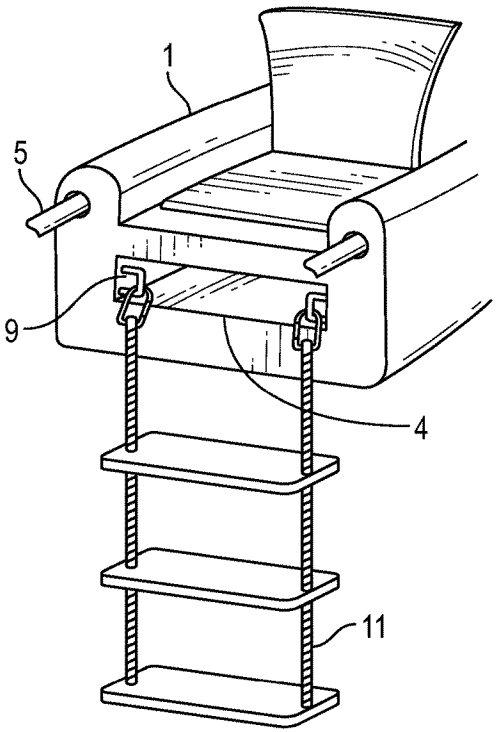
FIG. 5 is perspective view showing one preferred embodiment of an alcove rope ladder deployed in the gap.

The alcove fixing points 9 can be used to secure and deploy an alcove foot stirrup 10 (see FIG. 4.) or an alcove rope ladder 11 (see FIG. 5.). They can also be used to attach and detach swimming, snorkeling and diving accessories, for example goggles, a facemask, a snorkel, a waterproof camera and a diving line, to give the user convenient access to these while in the water between the connecting poles.

The alcove foot stirrup 10 clips to the fixing points 9 using climbing carabiners (see FIG. 4) or another suitable, water- and rust-resistant closure device at each end. The foot stirrup 10 is preferably made of nylon webbing or another waterproof, strong and yet flexible material. It can be stored in the gap storage alcove already attached to the alcove fixing points 9, and ready to simply pull out when the user requires. To renter the kayak, the user can place left and right hands either side of the gap, placing body weight on the kayak connecting poles 5, and with one foot in the foot stirrup 10, climb back into the kayak seat.

FIG. 5 shows a rope ladder 11 deployed similarly to the foot stirrup 10 in FIG. 4.

Figure 7:
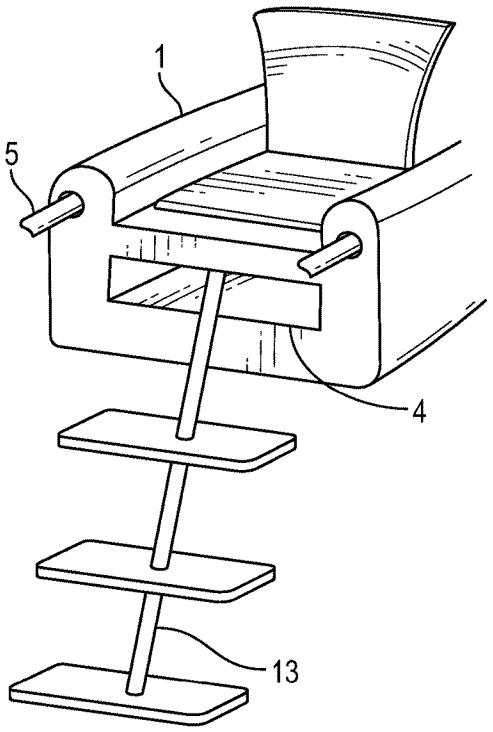
FIG. 7 is perspective view showing one preferred embodiment of an alcove telescoping dive ladder deployed in the gap.
Figure 6:
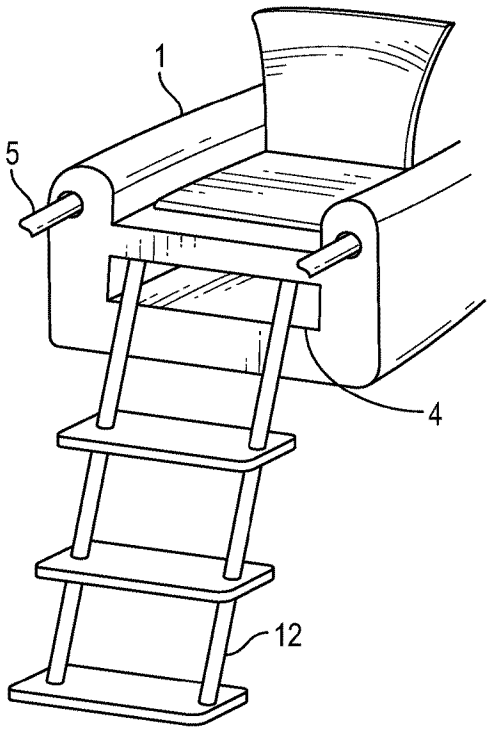
FIG. 6 is perspective view showing one preferred embodiment of an alcove telescoping ladder deployed in the gap.

FIGS. 6 and 7 show respectively an alcove telescoping ladder 12 and an alcove telescoping dive ladder 13 deployed in the gap. Such ladders are commonly available and described as "under platform boating ladders", because they attach with various mechanisms under a swimming or diving platform on a boat. For this invention, the roof of the gap storage alcove serves as the underside of a platform, i.e. any existing telescoping ladder capable of being fixed under a platform can also be fixed to the roof of the gap storage alcove, i.e. it can be stored in and deployed from the gap storage alcove.

The gap storage alcove 4 could be placed either in the kayak back section 1 or the front kayak front section 2, or both sections could have such alcoves. In all cases, such alcove opening faces the gap, to allow a user ready access from the gap, and when seated in the kayak.

Figure 8:
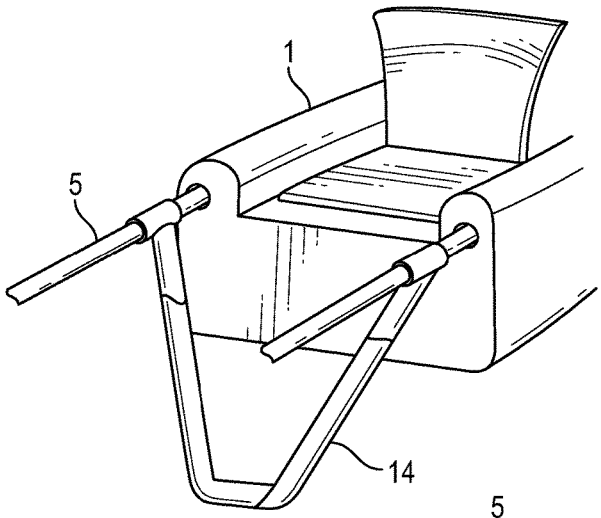
FIG. 8 is perspective view showing one preferred embodiment of a free hanging foot stirrup deployed in the gap.

FIG. 8 shows a free hanging foot stirrup 14 deployed in the gap. It is "free hanging" because it can be stored freely anywhere the user wants when not in use (for example in a storage hatch commonly found in a sit-on-top kayak) and then hung at any point in the gap the user finds most convenient. The free hanging foot stirrup is preferably made of nylon webbing or another waterproof, strong and yet flexible material that wraps at each end around the kayak connecting poles, then secures preferably with Velcro or a buckle, used also to adjust the total length of the foot stirrup, and hence the distance it hangs below the gap.

Figure 9:
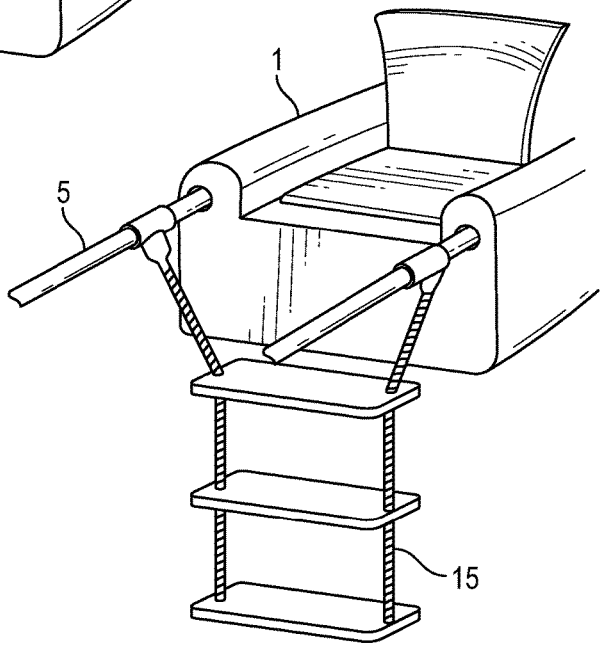
FIG. 9 is perspective view showing one preferred embodiment of a free hanging rope ladder deployed in the gap.

FIG. 9 shows a free hanging rope ladder 15 similarly deployed in the gap.

Figure 10:
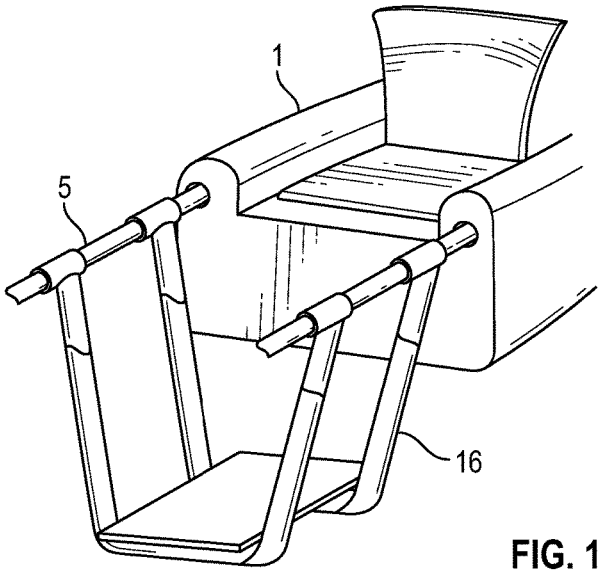
FIG. 10 is perspective view showing one preferred embodiment of a free hanging platform/seat deployed in the gap.

FIG. 10 shows a free hanging seat/platform/step similarly deployed in the gap. The hanging base of this would be made rigid, preferably with plastic or wood, to allow the user to sit, kneel or stand, depending on the depth the user sets it to hang below the connecting poles.

Figure 11:
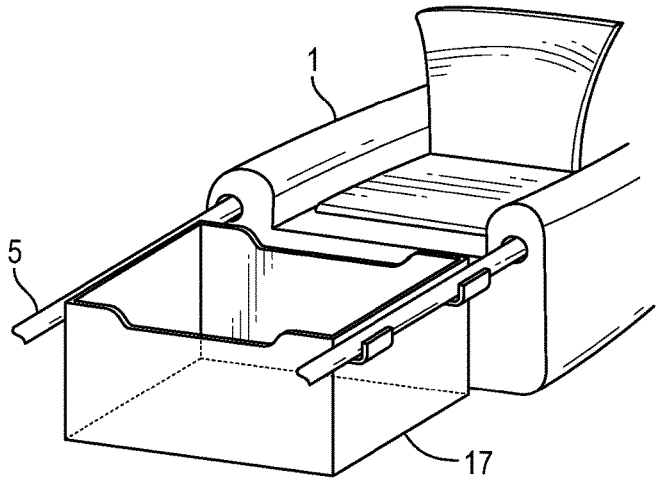
FIG. 11 is perspective view showing one preferred embodiment of a viewing portal deployed in the gap.
Figure 12:
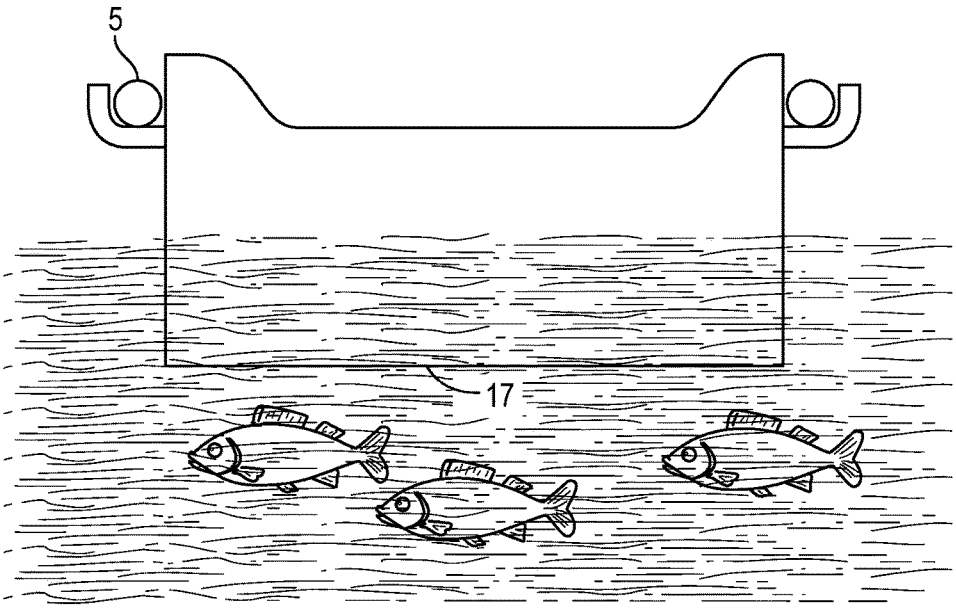
FIG. 12 is front view of one preferred embodiment of a viewing portal deployed in the gap.

FIGS. 11 and 12 show one preferred embodiment of a viewing portal 17 deployed in the gap. This is simply a plastic box, with transparent plastic or inserted plexiglass base. The buoyancy of the box when deployed keeps it firmly in place under the connecting poles.

Figure 13:
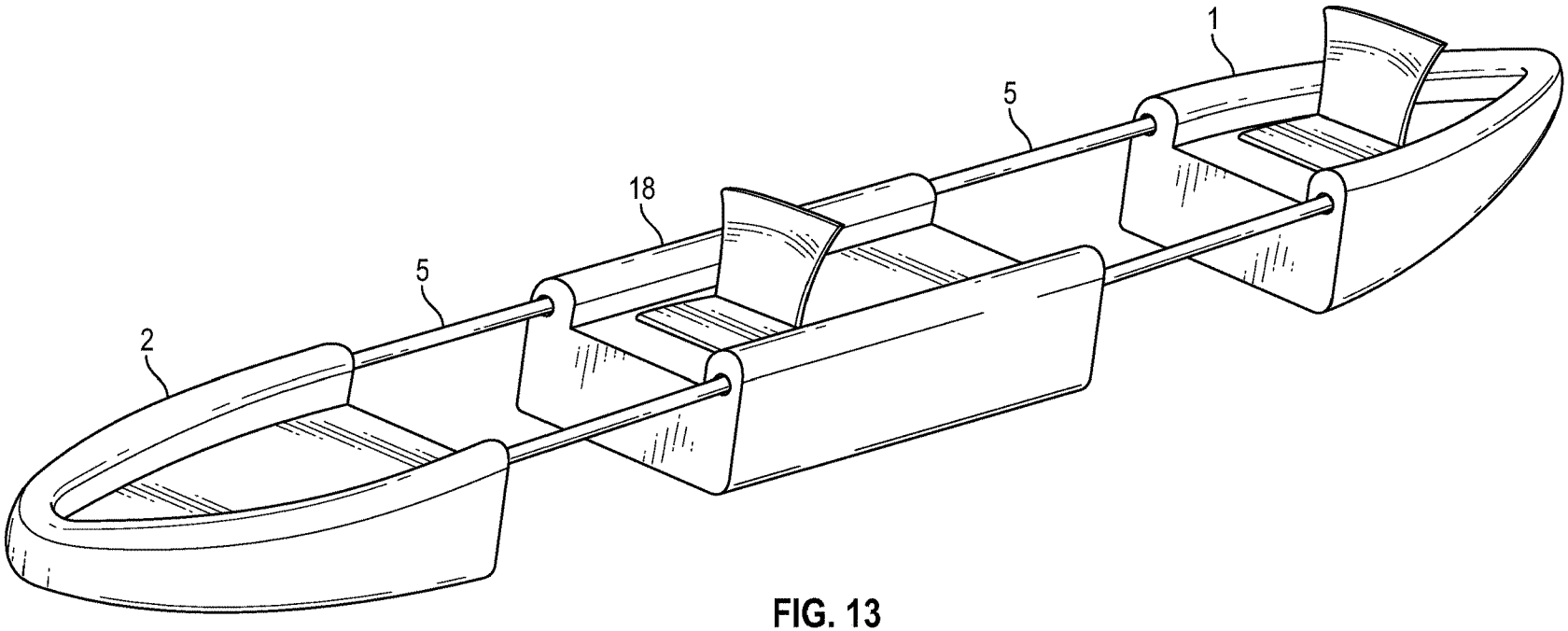
FIG. 13 is perspective view showing one preferred embodiment of an additional section used to extend the length of the kayak.

FIG. 13 shows how the kayak could be extended with an optional third section to have two gaps for two users in the same kayak. This would effectively convert a single kayak into a double kayak, requiring only a center section 18 rather than the purchase (and need to store) a double kayak.

In a preferred embodiment, the invention provides a kayak, where the kayak comprises a kayak front section, a kayak back section and two connecting poles, where the two connecting poles extend from the kayak front section to the kayak back section, where the kayak front section can be separated from the kayak back section by being slid along the two connecting poles to create a gap of desired width between the kayak front section and the kayak back section, where the kayak front section has a front interior cavity containing a front quantity of air and the kayak back section has a back interior cavity containing a back quantity of air, where separation of the kayak back section and the kayak front section to create a gap causes no loss of air from either the kayak front section interior cavity or the kayak back section interior cavity, where a user seated in the kayak facing a gap opened between the kayak front section and the kayak back section will have one connecting pole to the left of the gap and one connecting pole to the right of the gap, where the user can enter and exit the water through the gap using his or her hands to place bodyweight on the connecting poles.

In another preferred embodiment, the kayak can have more than two rigid connecting members—which can be circular, oval, square or rectangular in cross section—with at least one rigid connecting member on either side of the kayak such that ladders and other accessories can be attached across both sides of the kayak to provide more stability. These accessories can be foot stirrups, rope ladders, rigid seat/platforms, viewing portals, and even additional kayak sections to turn a single kayak into a double kayak. It is contemplated that some accessories can be stored and hung from the alcove, or attached directly to the rigid connecting members.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

REFERENCE NUMERALS USED

1. Kayak back section
2. Kayak front section
3. Gap
4. Gap storage alcove
5. Connecting pole
6. Connecting pole latch recess
7. Connecting pole latch
8. Hidden connecting pole
9. Alcove fixing point
10. Alcove foot stirrup
11. Alcove rope ladder
12. Alcove telescoping ladder
13. Alcove telescoping dive ladder
14. Free hanging foot stirrup
15. Free hanging rope ladder
16. Free hanging platform/seat
17. Viewing portal
18. Kayak third section That which is claimed:

1. A kayak, comprising a kayak front section, a kayak back section and two connecting poles, where the two connecting poles extend from the kayak front section to the kayak back section, where the kayak front section can be separated from the kayak back section by being slid along the two connecting poles to create a gap of desired width between the kayak front section and the kayak back section, where the kayak front section has a front interior cavity containing a front quantity of air and the kayak back section has a back interior cavity containing a back quantity of air, where separation of the kayak back section and the kayak front section to create a gap causes no loss of air from either the kayak front section interior cavity or the kayak back section interior cavity, where a user seated in the kayak facing a gap opened between the kayak front section and the kayak back section will have one connecting pole to the left of the gap and one connecting pole to the right of the gap, where the user can enter and exit the water through the gap using his or her hands to place bodyweight on the connecting poles, additionally comprising one or more alcoves added to either or both the kayak front section and the kayak back section, where each of the one or more alcoves has an opening facing the gap, allowing the user of the invention to access items stored in the one or more alcoves when the gap is in an open position, where each of the one or more alcoves is sealed except for its open face.

2. A kayak, comprising a kayak front section, a kayak back section and one or more rigid connecting members, where the kayak front section can be separated from the kayak back section by being slid along the one or more connecting members to create a gap, and where a user of the invention can enter and exit the water through the gap, where the kayak front section has a front interior cavity containing a front quantity of air and the kayak back section has a back interior cavity containing a back quantity of air, where separation of the kayak back section and the kayak front section to create a gap causes no loss of air from either the kayak front section interior cavity or the kayak back section interior cavity, where the number of rigid connecting members is two or more, and where a user seated in the kayak facing a gap opened between the kayak front section and the kayak back section will have at least one rigid connecting member to the left of the gap and at least one rigid connecting member to the right of the gap, where at least one rigid connecting member to the left of the gap is a connecting pole with a circular cross section, and at least one rigid connecting member to the right of the gap is a connecting pole with a circular cross section.

3. The kayak of claim 2, additionally comprising a foot stirrup, where the foot stirrup is attached at one end to a rigid connecting member on one side of the gap, and at its other end to a rigid connecting member on the other side of the gap, where a user of the invention in the water between the kayak front section and the kayak back section may place a foot in the foot stirrup to more easily climb back into the kayak back section.

4. The kayak of claim 2, where a rope ladder with a top left connection point and a top right connection point is attached at its top left connection point to a rigid connecting member on one side of the gap, and its top right connection point is attached to a rigid connecting member on the other side of the gap, where a user of the invention in the water between the kayak front section and the kayak back section may use the rope ladder to more easily climb back into the kayak back section.

5. The kayak of claim 2, additionally comprising a submerged rigid seat/platform, where the submerged rigid seat/platform is suspended from one or more attaching points on the rigid connecting members on either side of the gap, where a user of the invention can sit, kneel or stand on the submerged rigid seat/platform, to rest or to paddle the kayak.

6. The kayak of claim 2, additionally comprising a viewing portal with a transparent base, where the viewing portal is attached between rigid connecting members on either side of the gap, where the transparent base of such viewing portal is submerged in the water, allowing a user of the invention seated in the kayak back section to observe an undersea world.

7. The kayak of claim 2, where the connecting poles with circular cross section slide in and out of two or more hidden connecting poles in either or both of the kayak front section and kayak back section, where the two or more hidden connecting poles have a hidden connecting pole diameter, and where the hidden connecting pole diameter is slightly larger than the connecting pole diameter, where latches on the two or more hidden connecting poles can be used to fix a desired gap width.

8. The kayak of claim 2, where one or more rigid connecting members to the left of the gap are telescoping poles, and one or rigid connecting members to the right of the gap are telescoping poles, where each such telescoping pole when fully extended has two or more telescoping pole sections visible in the gap.

9. The kayak of claim 2, additionally comprising one or more alcoves added to either or both the kayak front section and the kayak back section, where each of the one or more alcoves has an opening facing the gap, allowing the user of the invention to access items stored in the one or more alcoves when the gap is in an open position, where each of the one or more alcoves is sealed except for its open face.

10. The kayak of claim 9, where at least one of the one or more alcoves has two or more fixing points, used to attach and detach items of use.

11. The kayak of claim 10, where a foot stirrup is attached to two of the two or more fixing points, and where the foot stirrup is stored in the alcove, such that a user of the invention may deploy such foot stirrup conveniently when required.

12. The kayak of claim 10, where a rope ladder is attached to two of the two or more fixing points, and where the rope ladder is stored in the alcove, so that a user of the invention may deploy such rope ladder conveniently when required.

13. The kayak of claim 9, where an under-platform telescoping ladder is installed in an alcove, where the under-platform telescoping ladder is attached to a roof of the alcove in the same way it would be attached under a boating platform.

14. The kayak of claim 9, where an under-platform telescoping dive ladder is installed in an alcove, where the under-platform telescoping dive ladder is attached to the roof of the alcove in the same way it would be attached under a boating platform.

15. A kayak, comprising a kayak front section, a kayak back section and one or more rigid connecting members, where the kayak front section can be separated from the kayak back section by being slid along the one or more connecting members to create a gap, and where a user of the invention can enter and exit the water through the gap, where the kayak front section has a front interior cavity containing a front quantity of air and the kayak back section has a back interior cavity containing a back quantity of air, where separation of the kayak back section and the kayak front section to create a gap causes no loss of air from either the kayak front section interior cavity or the kayak back section interior cavity, where the number of rigid connecting members is two or more, and where a user seated in the kayak facing a gap opened between the kayak front section and the kayak back section will have at least one rigid connecting member to the left of the gap and at least one rigid connecting member to the right of the gap where at least one rigid connecting member to the left of the gap is a pole with rectangular cross section, and at least one rigid connecting member to the right of the gap is a pole with rectangular cross section.

* * * * *